US006659666B2

(12) United States Patent
Kashino

(10) Patent No.: US 6,659,666 B2
(45) Date of Patent: Dec. 9, 2003

(54) KEY TOP ASSEMBLY INTEGRATED WITH A FILM

(75) Inventor: Masayuki Kashino, Tokyo (JP)

(73) Assignee: Polymatech Co., LTD, Tokyo (JP)

( * ) Notice: Subject to any disclaimer, the term of this patent is extended or adjusted under 35 U.S.C. 154(b) by 0 days.

(21) Appl. No.: 09/859,745

(22) Filed: May 17, 2001

(65) Prior Publication Data

US 2002/0025209 A1 Feb. 28, 2002

(30) Foreign Application Priority Data

Aug. 23, 2000 (JP) ..... 2000-252972

(51) Int. Cl.[7] ..... B41J 5/12
(52) U.S. Cl. ..... 400/490; 400/472
(58) Field of Search ..... 400/490, 493, 400/485, 489, 493.1, 493.2, 472

(56) References Cited

U.S. PATENT DOCUMENTS 4,471,189 A * 9/1984 Bacon et al. ..... 200/159
5,642,950 A * 7/1997 Hochgesang et al. ..... 400/490
5,879,088 A * 3/1999 English ..... 400/481
6,313,731 B1 * 11/2001 Vance ..... 338/185
6,313,826 B1 * 11/2001 Schrum et al. ..... 345/161
6,369,692 B1 * 4/2002 Van Zeeland ..... 338/200
6,377,246 B1 * 4/2002 Wild ..... 345/168

* cited by examiner

*Primary Examiner*—Andrew H. Hirshfeld
*Assistant Examiner*—Anthony H. Nguyen
(74) *Attorney, Agent, or Firm*—McGlew and Tuttle, P.C.

(57) ABSTRACT

A key top assembly integrated with a film, wherein: a plurality of key tops can be placed inside one frame; and a resin film 13 which connects the body of a circumferential outer key top 1 to the body of a core key top 2 placed inside the body of the above-mentioned outer key top is formed into a bent shape at a position lower than the lower ends of the areas where the resin film is bonded to the bodies of the key tops, or the interior portion of the base of the body of the outer key top is cut out with the result that that the interior portion of the base is formed at a position higher than that of the exterior portion of the base; and whereby: the clearance between the key tops is rendered small; no key top interlocks with any adjacent key top; and a good appearance is presented.

11 Claims, 5 Drawing Sheets

(a)

(b)

KEY TOP ASSEMBLY INTEGRATED WITH A FILM

BACKGROUND OF THE INVENTION

1. Technical Field of the Invention

This invention relates to a key top assembly which is integrated with a film and is built into the input portion of equipment such as a telephone, a mobile communications device, an acoustic equipment, a television set, a video cassette recorder, a facsimile machine, a copying machine, and an on-vehicle device.

2. Related Art

In conjunction with the fact that electric and electronic devices have become compact and portable, there is a demand for smaller, thinner and lighter push-button switches for use in the operational portions of such devices.

By way of a measure to meet such a demand is known a key top assembly integrated with a film as shown in FIG. 7, wherein required characters and symbols are printed on the upper surface or on the undersurface of a transparent or translucent flexible resin film 17, and a key top body 18 is attached, by a technique such as fusion or bonding, to the interior of each recess formed by the above-mentioned resin film 17 bent upward. The arrangement of this key top assembly integrated with a film, as it is mounted on a device, is such that each key top body 18 is placed separately from others inside one of the frames of a mounting 19.

In recent years, as regards push button switches used in carrying out a retrieval function of devices such as cellular telephones and portable terminals, there has been a growing demand for a push button switch designed in such a way that a core key top is placed inside an annular key top. In the event that a key top assembly thus designed is mounted on a pertinent device, then it follows that an annular key top and a core key top are placed inside a single frame, with the result that the clearance between the two adjacent key tops is very small.

Problems to be Solved by the Invention

However, in the case of a prior art key top assembly integrated with a film, wherein the clearance between adjacent key tops is small, when one of the key tops is pressed, at least one of the adjacent key tops becomes interlocked, thus presenting a problem. For the purpose of avoiding the interlocking of adjacent key tops, the two following types are available: a key top assembly integrated with a film as shown in FIG. 8, wherein a groove 20 is formed at approximately the center of that portion of a resin film which is located between adjacent key tops; and a key top assembly integrated with a film as shown in FIG. 9, wherein slits 22 are machined in those portions of a resin film which are located between adjacent key tops.

It is true that the interlocking of key tops can be prevented in the case of the above-mentioned types, but it is necessary that the clearance between adjacent key tops be rendered large. Therefore, in the case of an arrangement wherein a plurality of key tops are placed inside one of the frames of a mounting, those portions of a resin film which are located between adjacent key tops are exposed, resulting in a crude appearance.

Means To Solve the Problems

The present invention, which seeks to solve the above-mentioned problems, provides a key top assembly integrated with a film in which a plurality of key tops can be placed inside one frame and which has the following features: clearances between adjacent key tops are rendered small; no key top interlocks with any other key top; and a good appearance is presented.

Namely, in the case of this key top assembly integrated with a film, a core key top is placed inside a circumferential outer key top, and that portion of a resin film which connects the body of the above-mentioned key top to the body of the above-mentioned core key top is formed into a bent shape in such a way that the lower end of this bent portion is located at a position lower than the lower ends of the areas where the above-mentioned resin film is bonded to the bodies of the above-mentioned two key tops.

Furthermore, as regards this key top assembly integrated with a film, the interior portion of the base of the above-mentioned circumferential outer key top is cut out, resulting in the interior portion of the above-mentioned base being formed at a position higher than that of the exterior portion of the above-mentioned base.

Moreover, as for this key top assembly integrated with a film, the body of the above-mentioned circumferential outer key top is annular.

DETAILED DESCRIPTION OF THE PREFERRED EMBODIMENTS

A detailed description of the present invention will be given below by referring to drawings.

Figure 1:
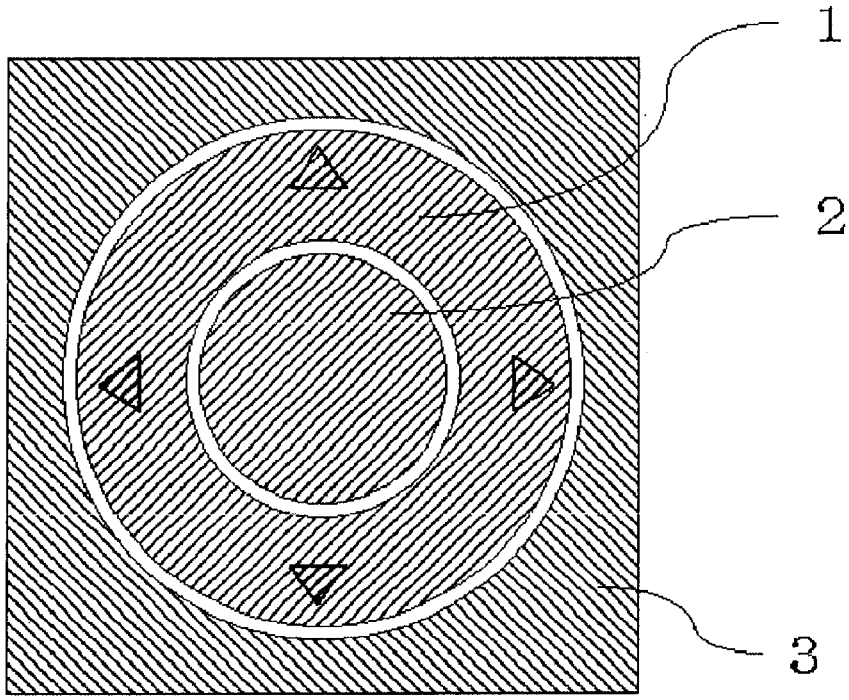
FIG. 1 is a top view of the present invention.

FIG. 1 is a top view of a typical embodiment of the present invention. As shown in FIG. 1, this embodiment comprises a core key top 2 located at the center and a circumferential outer key top surrounding the outside of the core key top 2 and is built into a frame 3.

Figure 2:
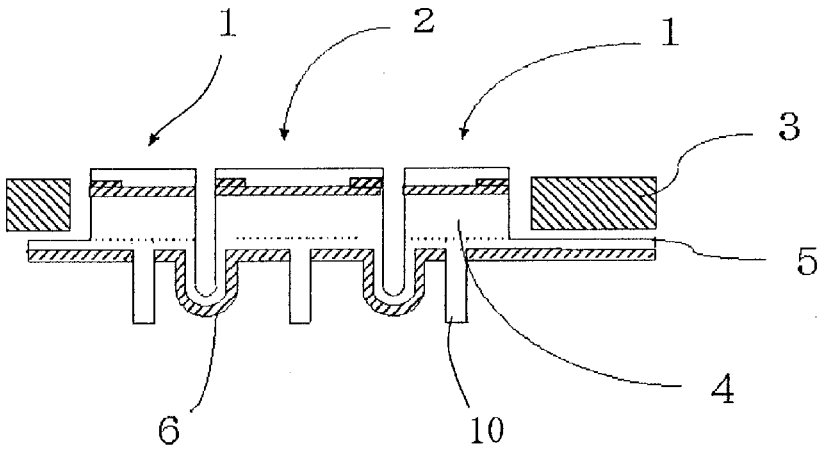
FIG. 2 is a longitudinal sectional view of an embodiment of the present invention.
Figure 3:
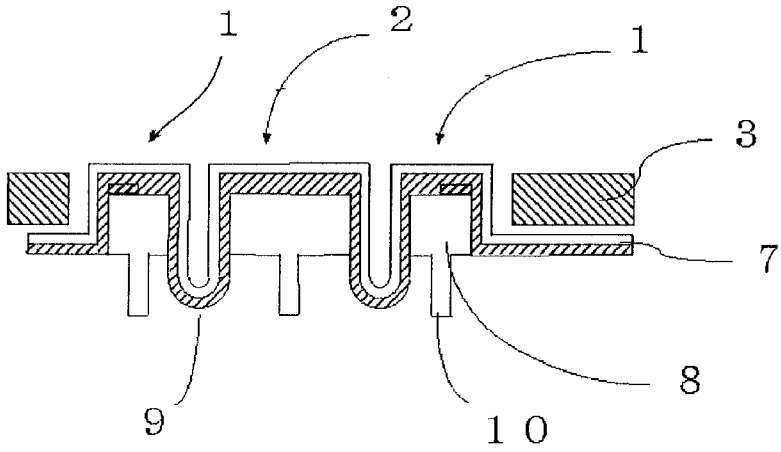
FIG. 3 is a longitudinal sectional view of another embodiment of the present invention.
Figure 8:
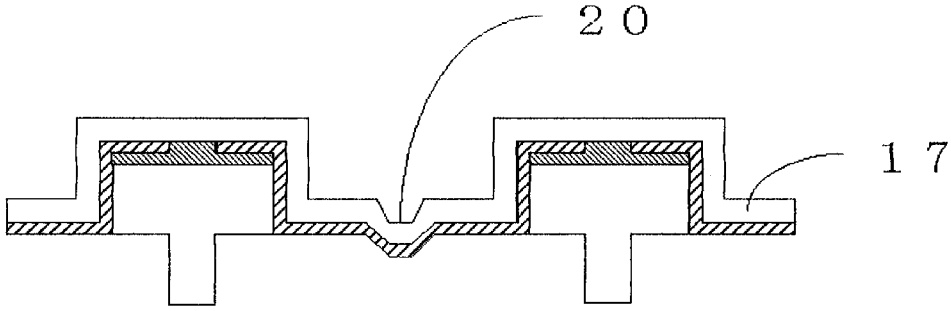
FIG. 8 is a longitudinal sectional view of another prior art key top assembly integrated with a film.
Figure 9:
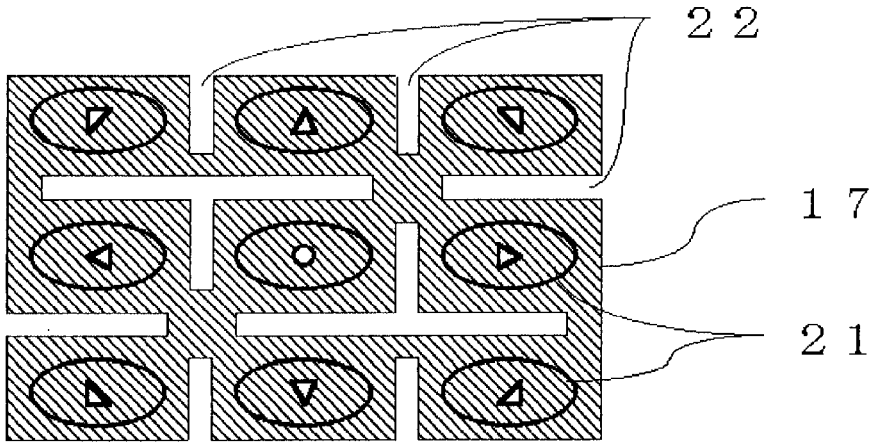
FIG. 9 is a longitudinal sectional view of yet another prior art key top assembly integrated with a film.

By way of specific examples of longitudinal sectional views of embodiments of the present invention, the following views can be enumerated: a longitudinal sectional view as shown in FIG. 2, wherein a resin film 5 is pierced by a push stud 10; a longitudinal sectional view as shown in FIG. 3, wherein a key top body 7 made from resin is integrated with a resin film 8 formed over the key top body 7 by being so bent as to have the same shape thereof. In FIG. 8 are shown resin films 5 and 8 which are transparent and the reverse side of each of which has a printed layer (shown hatched).

Figure 4:
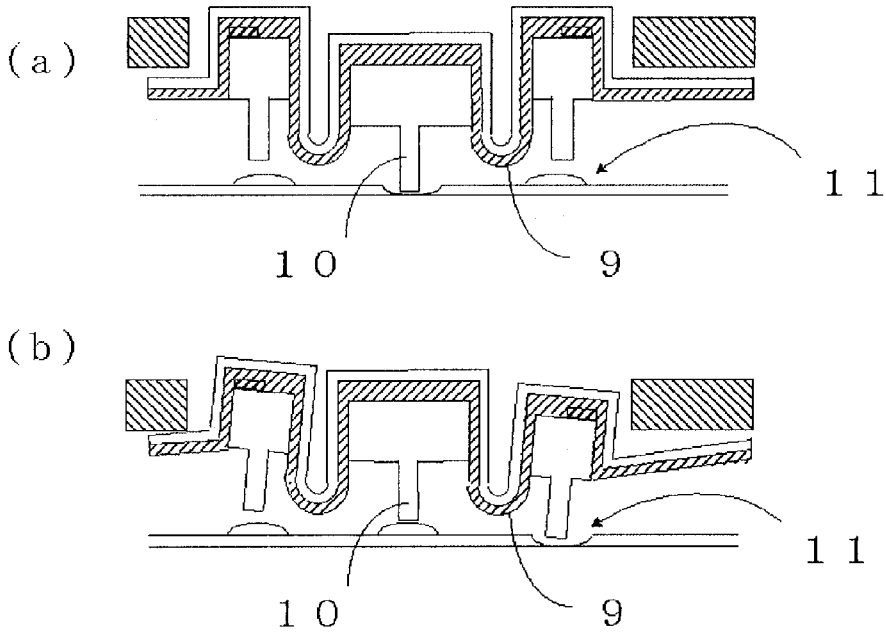
FIG. 4 shows the operation of a switch of an embodiment of the present invention.

Referring to FIG. 4, a description of the operation of the switch pertaining to the key top assembly integrated with a film, as shown in FIG. 3, will be made. A connection portion 9, which is part of the resin film 8 and is located between a circumferential outer key top 1 and a core key top 2, is formed into a bent shape in such a way that the lower end of this bent portion is located at a position lower than the lower end of the area where the resin film 8 is bonded to the key top body 7. Consequently, when a required key top is depressed, the other adjacent key top does not become interlocked in spite of the fact that that the clearance between the circumferential outer key top 1 and the core key top 2 is small. In fact, when a key top was depressed, it was possible to have a distinct clicking feel caused by a Belleville spring 11.

Figure 5:
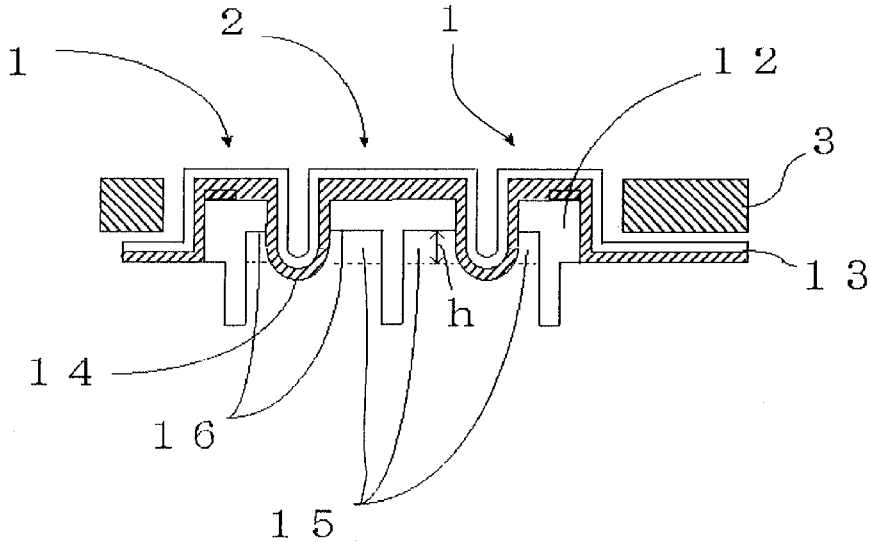
FIG. 5 is a longitudinal sectional view of the example of the present invention.
Figure 6:
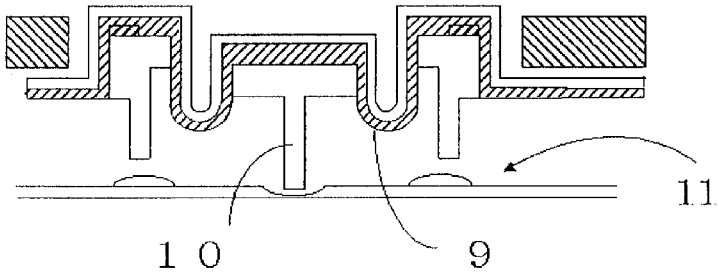
FIG. 6 shows the operation of a switch of the example of the present invention.
Figure 6:
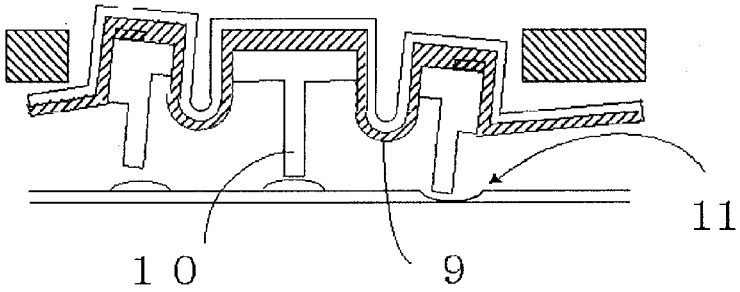
Figure 7:
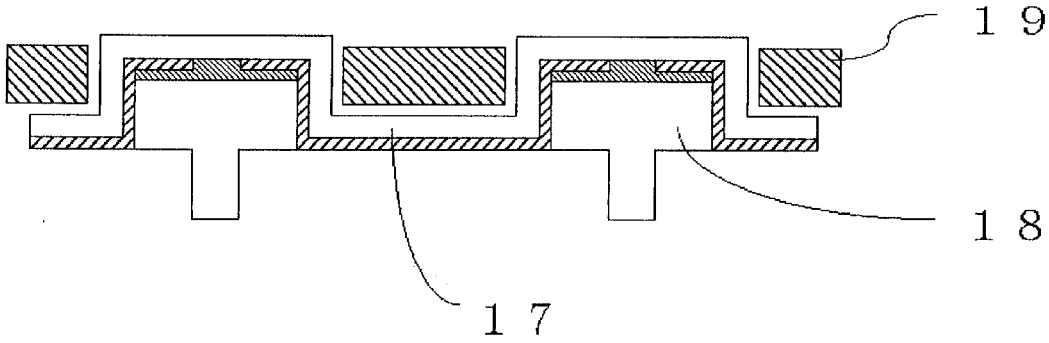
FIG. 7 is a longitudinal sectional view of a prior art key top assembly integrated with a film.

In the event that those bottom portions of two key top bodies which are adjacent to each other are cut out to form cutouts 16 shown in FIG. 5, then the switch stroke can be adjusted appropriately depending on the dimension of a height h, as is evident from the description given of the switch operation in FIG. 6. Furthermore, the depth of drawing required to bend downward that portion of the resin film 8 which is located between the two key tops is less than in the case of the embodiment shown in FIG. 3, thereby facilitating drawing work.

The cross-sectional shape of that connection portion of the resin film of the present invention that is formed into a bent shape may comprise either a curved portion only or a combination of a curved portion and of a straight portion. However, in the event that the above-mentioned connection portion comprises a curved portion only, then the clearance between the key tops can be rendered smaller than otherwise.

Figure 10:
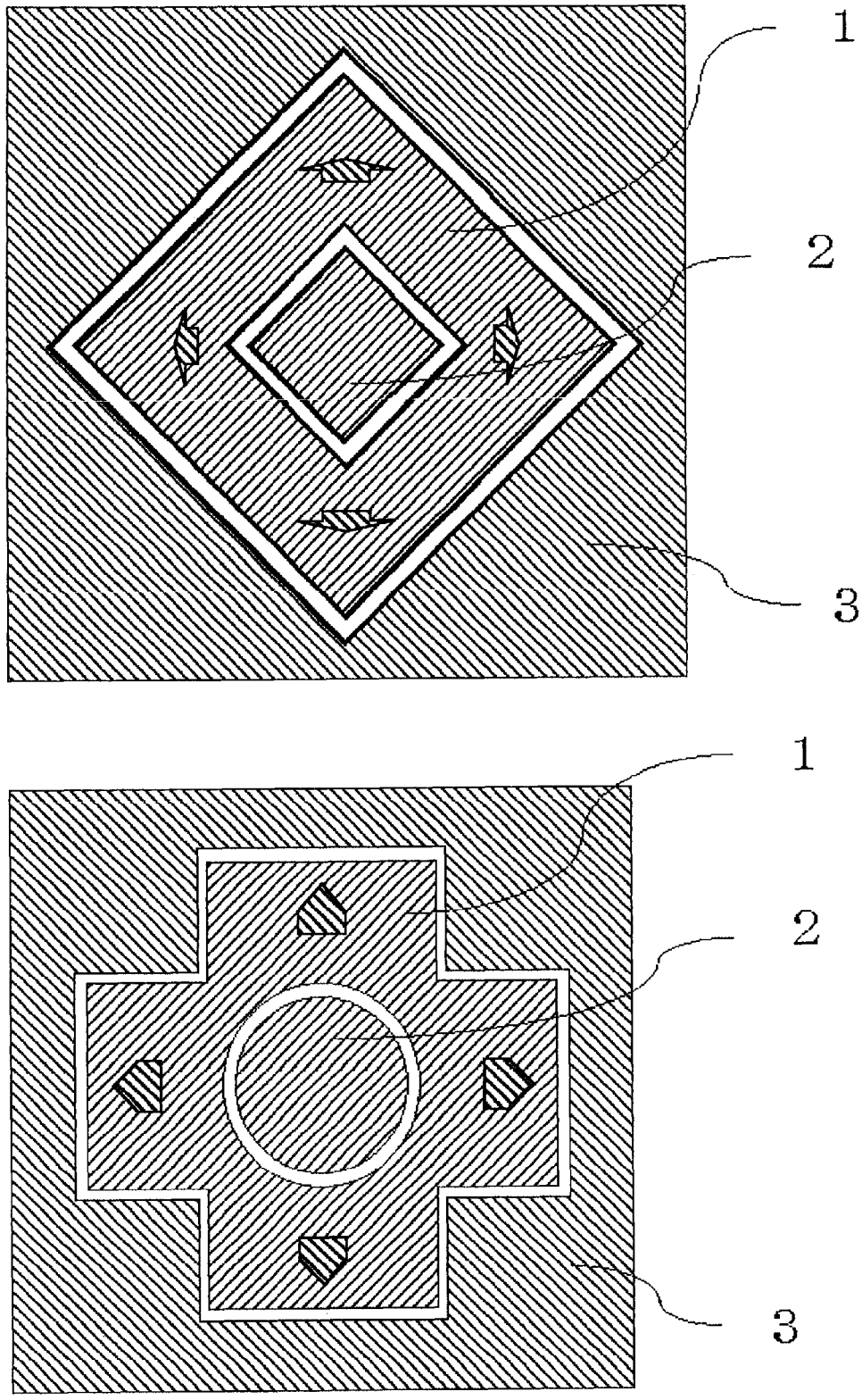
FIG. 10 contains top views of two other embodiments of the present invention.

The shape of that circumferential outer key top of the present invention which surrounds the outside of the core key top may be either annular or polygonal as shown in FIGS. 1 and 10.

Embodiment

The description of the example of the present invention is as follows. As shown in FIG. 5, which is a longitudinal sectional view of the example of the present invention, a circumferential outer key top 1 is an annular key top, inside which was formed a core key top 2.

In this case, the arrangement of the key top assembly integrated with a film is as follows. On the undersurface of a transparent resin film 13 made from polyethylene terephthalate are printed some symbols to provide an indication portion. Also printed on the above-mentioned undersurface is a layer which is colored white. The resin film 13 was drawn by means of a jig into an upward bent shape, and then polycarbonate resin was injection-molded inside the resulting bent portion, thereby forming a key top body 12. The bottom face of the body of the circumferential outer key top 1 was formed at a high position by being cut out. The bottom face of the body of the core key top 2 was formed at the same height as that of the bottom face of the body of the circumferential outer key top 1. Moreover, a connection portion 14, which is part of the resin film 13 and is located between the body of the circumferential outer key top 1 and the body of the core key top 2 was formed into a bent shape in such a way that the lower end of this bent portion is located at a position lower than lower ends 16 of the area where the resin film 13 is bonded to cutouts 15 of the body of the circumferential outer key top 1 and of the body of the core key top 2.

FIG. 6 shows the operation of a switch of this example. When the key top was depressed, as shown in FIG. 6(*a*), it was possible to have a distinct clicking feel caused by a Belleville spring 11 placed underneath a push stud 10. When each of the four indication portions provided on the annular key top 1 was depressed, as shown in FIG. 6(*b*), the core top key 2 did not go so far as to press the Belleville spring 11, thus avoiding interlocking.

According to the present invention, that portion of a resin film which is located between a circumferential outer key top and a core key top is formed by being bent downward, thereby being capable of providing a compact key top assembly integrated with a film whereby:

no key top interlocks with any adjacent key top even if the clearance between key tops is rendered small; and moreover, a good appearance is presented.

Another advantageous effect, among others, of this arrangement, which it was not possible to embody until now, is that inside an annular key, another key top having a different function can be placed, thereby permitting a plurality of key tops to be placed inside one frame.

Furthermore, since that portion of the resin film which is located between key tops is formed into a bent shape, any key top returns to its original position after being pressed.

Moreover, the since the structure of the metal mold for molding key tops are simplified, it becomes possible to increase the rate of turnout of products, thereby permitting production costs to be reduced.

What is claimed is:

1. A key top assembly integrated with a film, wherein: a key top body made from a resin is integrated with a resin film, the resin film is formed by being bent to the same shape as that of an upper surface of the key top body, the resin film linking bottom ends of side surfaces of at least two adjacent key top bodies, a core key top of said two key top bodies is placed inside a circumferential outer key top of said two key top bodies, and the resin film which connects the body of said circumferential outer key top to the body of said core key top is formed into a bent shape at a position lower than lower ends of areas where said resin film is bonded to the bodies of said two key tops.

2. A key top assembly integrated with a film as claimed in claim 1, wherein an interior portion of a base of the body of said circumferential outer key top and a base of the core key top, by which the lower end of the area where the resin film is bonded to the key top body is formed, are cut out, resulting in the interior portion of the base of the body of the circumferential outer key top and the base of the core key top being formed at a position higher than that of the exterior portion of the base of the body of the circumferential outer key ton.

3. A key top assembly integrated with a film as claimed in claim 1, wherein the body of said circumferential outer key top is annular.

4. A key top assembly integrated with a film as claimed in claim 2, wherein the body of said circumferential outer key top is annular.

5. A key top assembly integrated with a film, wherein a key top body made from a resin is integrated with a resin film, the key top body has a push stud by which the resin film is pierced, the resin film linking bottom ends of side surfaces of at least two adjacent key top bodies, a core key top is placed inside a circumferential outer key top, and the resin film which connects the body of said circumferential outer key top to the body of said core key top is formed into a bent shape at a position lower than lower ends of areas where said resin film is bonded to the bodies of the said two key tops.

6. A key top assembly integrated with a film as claimed in claim 5, wherein the body of said circumferential outer key top is annular.

7. A key assemble comprising:

a switch substrate;

first and second key bodies separated by a gap and movable toward and away from said switch substrate, each key body having a display surface and a substrate surface, said display surface being substantially diametrically opposite said substrate surface of a respective said key body;

a resin film connecting said first and second key bodies, said resin film having a U-shaped section in a gap area between said first and second key bodies, said U-shaped section being arranged between said switch substrate and said substrate surface of said key bodies, said U-shaped section also being spaced from said substrate surfaces and said switch substrate.

8. A key assemble in accordance with claim 7, wherein: said U-shaped section of said resin film is spaced from said substrate surfaces in a direction from said display surfaces to said substrate surfaces.

9. A method in accordance with claim 8, wherein:

said first and second key bodies each have a transverse side extending from respective said display surfaces to respective said substrate surfaces; said resin film extends over, and is in contact with, said display surfaces and said transverse sides of said first and second key bodies, said resin film extending from said display surfaces of said key bodies, along said transverse sides and continues past said substrate surfaces in a direction from said display surfaces to said substrate surfaces, said resin film extending past said substrate surfaces connecting to form a U shape spaced from said substrate surface.

10. A key assemble in accordance with claim 9, wherein:

transverse sides of said first key body is surrounded by the U-shaped section of said resin film, said second key body has an annular shape, and transverse sides of said U-shaped section of the resin film are surrounded by said second key body.

11. A key assemble in accordance with claim 9, wherein:

said second key body has an annular shape and surrounds said first key body;

said U-shaped section of said resin film forms an annular ring in a plane between said key bodies and said switch substrate, said annular ring surrounding an axis connecting said first key body and said switching substrate.

* * * * *